US010426252B2

(12) United States Patent
Moskovich et al.

(10) Patent No.: US 10,426,252 B2
(45) Date of Patent: Oct. 1, 2019

(54) ORAL CARE SYSTEM AND METHOD

(71) Applicant: COLGATE-PALMOLIVE COMPANY, New York, NY (US)

(72) Inventors: Robert Moskovich, East Brunswick, NJ (US); Matthew Kolb, Upper Black Eddy, PA (US)

(73) Assignee: Colgate-Palmolive Company, New York, NY (US)

( * ) Notice: Subject to any disclaimer, the term of this patent is extended or adjusted under 35 U.S.C. 154(b) by 118 days.

(21) Appl. No.: 15/503,645

(22) PCT Filed: Aug. 14, 2014

(86) PCT No.: PCT/US2014/051128
§ 371 (c)(1),
(2) Date: Feb. 13, 2017

(87) PCT Pub. No.: WO2016/024984
PCT Pub. Date: Feb. 18, 2016

(65) Prior Publication Data
US 2017/0245630 A1 Aug. 31, 2017

(51) Int. Cl.
*B65D 35/00* (2006.01)
*A46B 11/00* (2006.01)
(Continued)

(52) U.S. Cl.
CPC ..... *A46B 11/0079* (2013.01); *A46B 9/04* (2013.01); *A46B 11/002* (2013.01);
(Continued)

(58) Field of Classification Search
CPC ..... B65D 35/24; B65D 35/28; B65D 35/285; B65D 35/46
(Continued)

(56) References Cited

U.S. PATENT DOCUMENTS 1,731,703 A 10/1929 Bourke
2,537,008 A 1/1951 Abbott
(Continued)

FOREIGN PATENT DOCUMENTS

CN 2357658 Y 1/2000
CN 200973462 11/2006
(Continued)

OTHER PUBLICATIONS

International Search Report and the Written Opinion of the International Searching Authority issued in international application PCT/US2014/051128 dated May 4, 2015.

*Primary Examiner* — David J Walczak
*Assistant Examiner* — Joshua R Wiljanen

(57) ABSTRACT

An oral care system includes a dispenser comprising a product tube having a reservoir containing an oral care material and an outlet. In one embodiment, the dispenser may be configured for detachable coupling to a toothbrush. A compression device engages the product tube and pressurizes the tube contents. The oral care material may be dispensed by actuating a valve fluidly coupled to the reservoir and outlet. In one embodiment, actuating the valve includes a flow orifice movable into and out of a flow path through the dispenser. Oral care material may be dispensed by positioning the orifice in the flow path in which the pressurized material flows outwards the product tube. To stop the flow of oral care material, the orifice is removed from the flow path which blocks the path. An operating button is provided in one embodiment to change position of the flow orifice.

13 Claims, 9 Drawing Sheets

(51) Int. Cl.
*A46B 9/04* (2006.01)
*B65D 35/28* (2006.01)
*B65D 35/46* (2006.01)

(52) U.S. Cl.
CPC ..... *A46B 11/0017* (2013.01); *A46B 11/0065* (2013.01); *A46B 11/0086* (2013.01); *A46B 2200/1066* (2013.01); *B65D 35/28* (2013.01); *B65D 35/46* (2013.01)

(58) Field of Classification Search
USPC ..... 401/152, 156, 158, 163, 263, 280; 222/95, 96, 103
See application file for complete search history.

(56) References Cited

U.S. PATENT DOCUMENTS

| | | | | |
|---|---|---|---|---|
| 2,759,636 | A | 8/1956 | Albert et al. | |
| 4,149,814 | A * | 4/1979 | Manwaring ..... | A46B 11/0055 401/155 |
| 4,565,303 | A | 1/1986 | Gilbertson | |
| 4,765,512 | A | 8/1988 | Bull, Jr. | |
| 5,105,984 | A | 4/1992 | Kazimir | |
| 5,323,932 | A * | 6/1994 | Bauman ..... | B65D 35/28 222/103 |
| 5,407,287 | A | 4/1995 | Braun | |
| 5,480,066 | A | 1/1996 | Blum | |
| 5,897,030 | A | 4/1999 | Stangle | |
| 7,077,292 | B2 | 7/2006 | Turano | |
| 7,237,974 | B2 * | 7/2007 | Pfenniger ..... | A46B 15/0055 401/118 |
| 9,173,477 | B2 | 11/2015 | Jimenez et al. | |
| 2006/0232683 | A1 | 10/2006 | Ichihashi | |
| 2011/0308030 | A1 | 12/2011 | Jimenez et al. | |

FOREIGN PATENT DOCUMENTS

| | | |
|---|---|---|
| DE | 101 10 372 | 9/2002 |
| FR | 1 524 378 | 5/1968 |

* cited by examiner

ORAL CARE SYSTEM AND METHOD

BACKGROUND

The present invention relates to oral care systems and related methods, and more particularly to a system and related method including a toothbrush and a detachable dispenser containing a dispensable fluidic oral care material.

Oral care materials or agents may be applied in variety of ways. For tooth whitening products, for example, a common technique used for applying tooth whitening products is to cast an impression of a person's teeth and provide a tray of the shape of this impression. A user then adds a whitening composition to the tray and applies the tray to his/her teeth. The tray is left in place for a period of time and then removed. Another technique is to use a whitening strip that has a whitening composition on one surface. This strip is applied to a person's teeth and left in place for a period of time. Yet another technique is to apply a whitening composition to teeth using a small brush. This brush is repeatedly dipped back into the container during the application of the tooth whitening composition to one's teeth. After a few treatments, the teeth gradually whiten using the foregoing techniques.

The foregoing approaches to oral care material storage, dispensing, and application may not be convenient and readily portable for travel. The oral care product is typically stored separately from the oral care tooth cleaning implements such as a toothbrush and treated as distinct parts of an oral care regimen which must be handled and packed separately.

A more portable, compact, and convenient way to store, dispense, and apply oral care materials to oral surfaces is desired.

BRIEF SUMMARY

According to an embodiment, an oral care material dispenser includes a housing defining a longitudinal axis, a pressurized product tube disposed in the housing and including a reservoir containing an oral care material, an outlet in fluid communication with the reservoir, and a valve fluidly coupled to the outlet. The valve is movable between an open dispensing position and a closed non-dispensing position. The valve is configured to dispense oral care material from the reservoir under pressure when in the dispensing position.

According to an embodiment, an oral care system includes a toothbrush including a head, and a handle coupled to the head and having an internal cavity, a dispenser detachably mounted in the internal cavity of the handle, and a dispenser. The dispenser includes a housing defining a longitudinal axis, a pressurized tube disposed in the housing and including a reservoir containing an oral care material, an outlet in fluid communication with the reservoir, and a valve fluidly coupled to the outlet. The valve is movable between an open dispensing position and a closed non-dispensing position. The valve is configured to dispense oral care material from the reservoir under pressure when in the dispensing position.

A method for dispensing an oral care material is provided. The method includes: providing a dispenser including a housing defining a longitudinal axis, a pressurized product tube disposed in the housing and including a reservoir containing an oral care material, and an outlet in fluid communication with the reservoir and defining a flow path for dispensing the oral care material; engaging opposite sides of the product tube with a compression device operably exerting an inward directed force on the reservoir; actuating a valve fluidly coupled to the outlet of the dispenser and including a flow orifice, the orifice movable into and out of the flow path; positioning the orifice into the flow path; and dispensing the oral care material from the dispenser.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
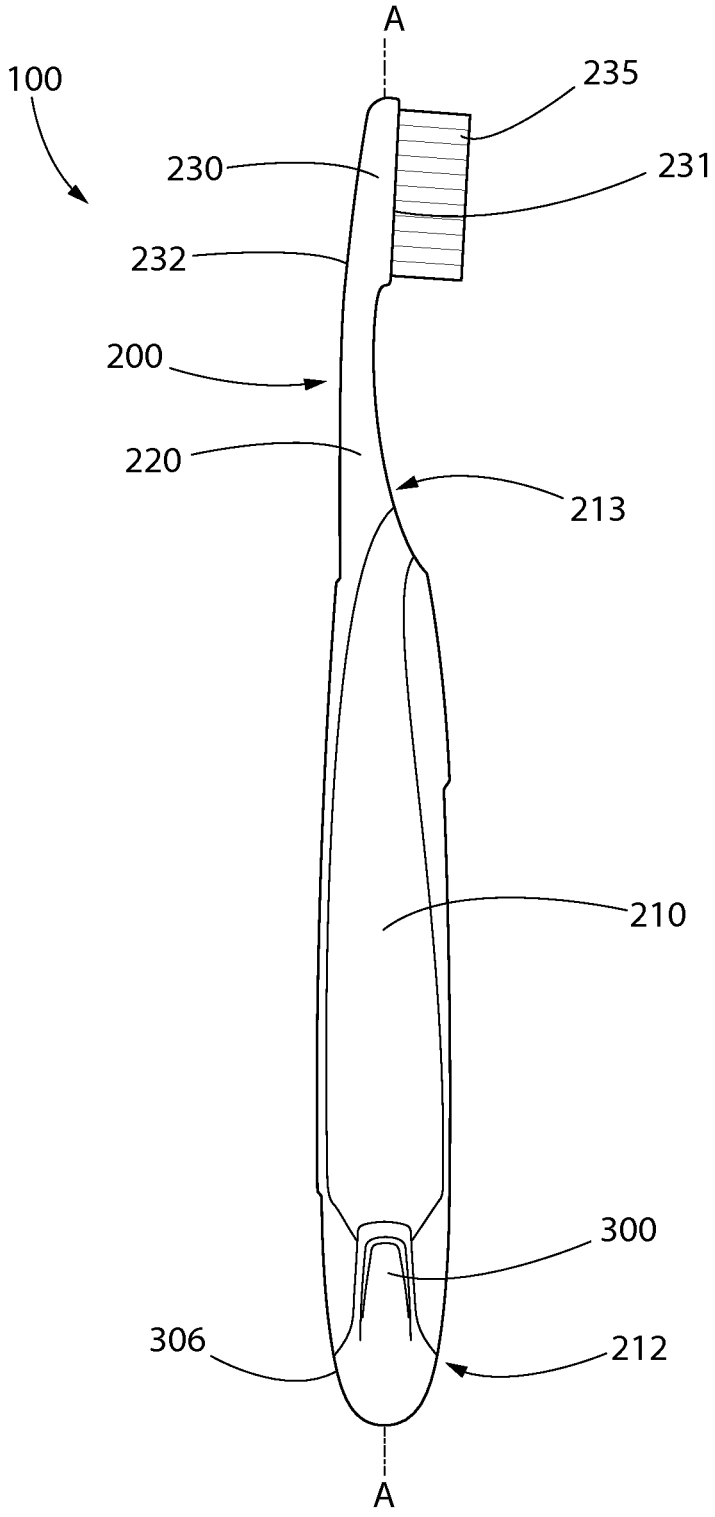
FIG. 1 is a side elevation view of an oral care system including a toothbrush and a fluid dispenser according to one embodiment of the present invention, wherein the dispenser is detachably coupled to the toothbrush.
Figure 2:
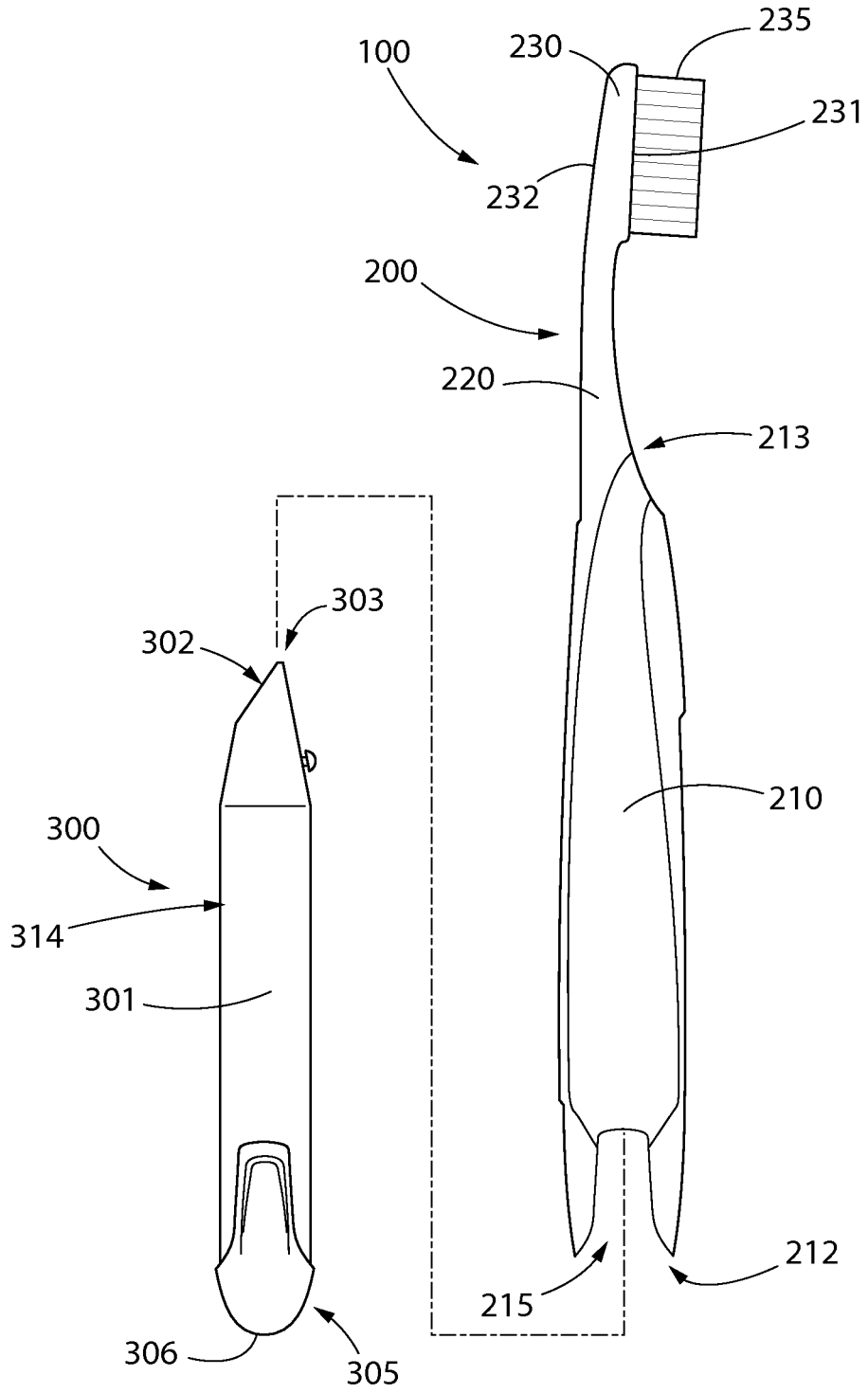
FIG. 2 is an exploded view thereof.
Figure 3:
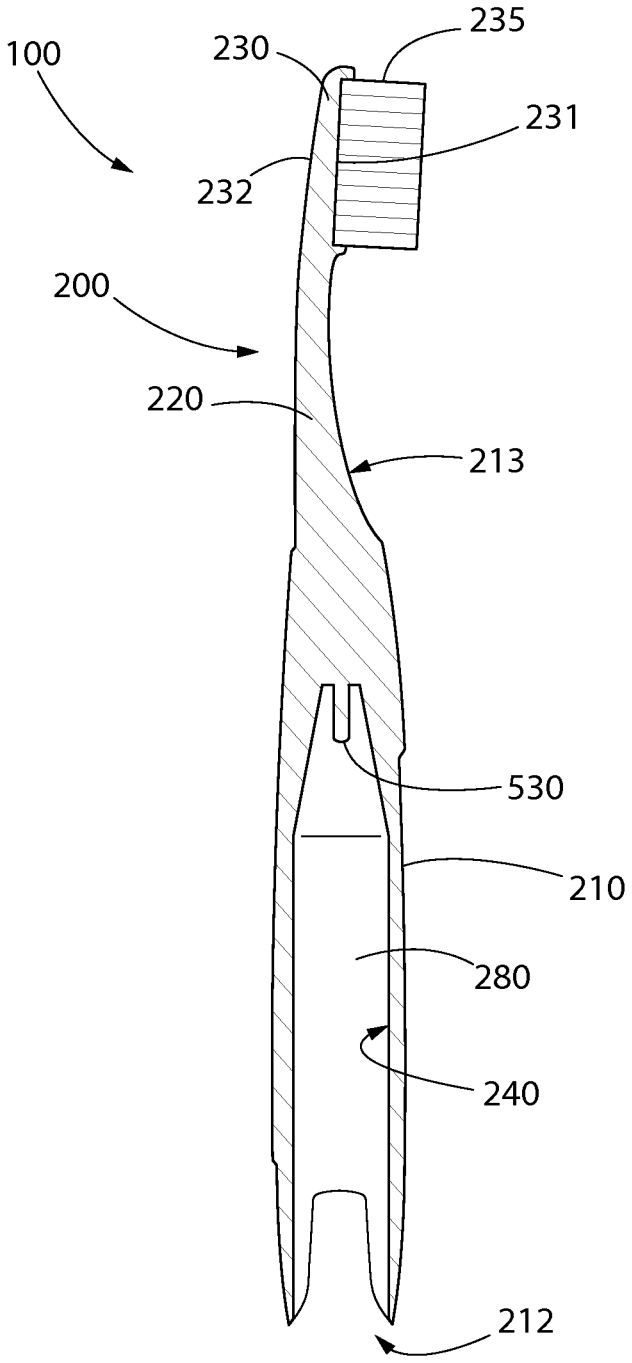
FIG. 3 is a side cross-sectional view of the toothbrush with dispenser removed.
Figure 4A:
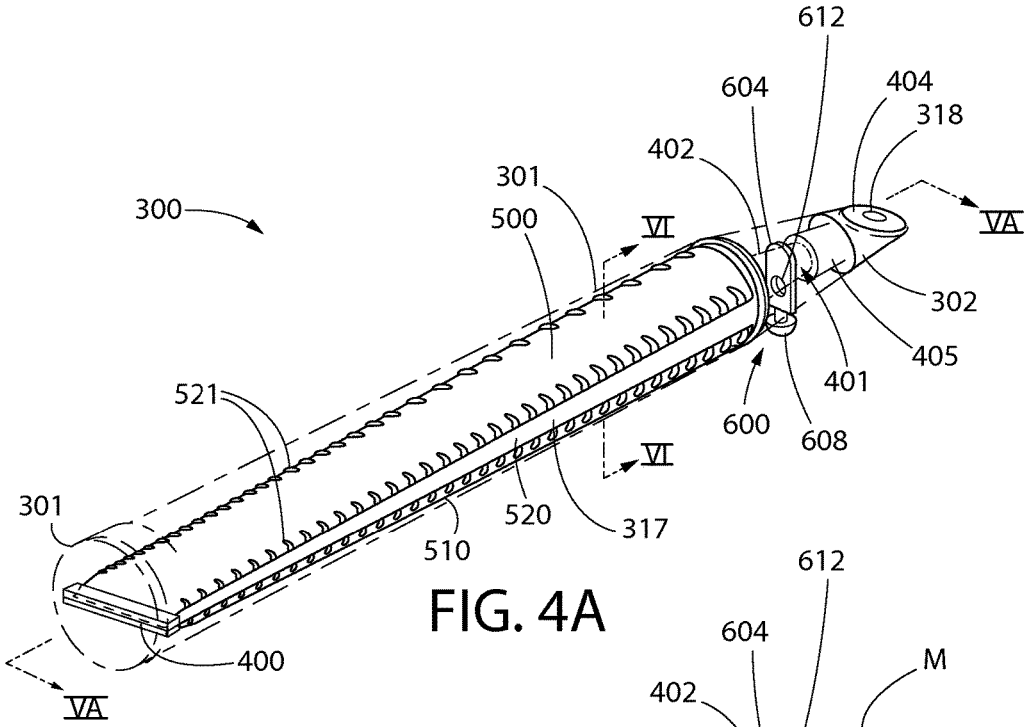
FIGS. 4A and 4B are perspective views of the dispenser with FIG. 4B showing an oral care material being dispensed.
Figure 4B:
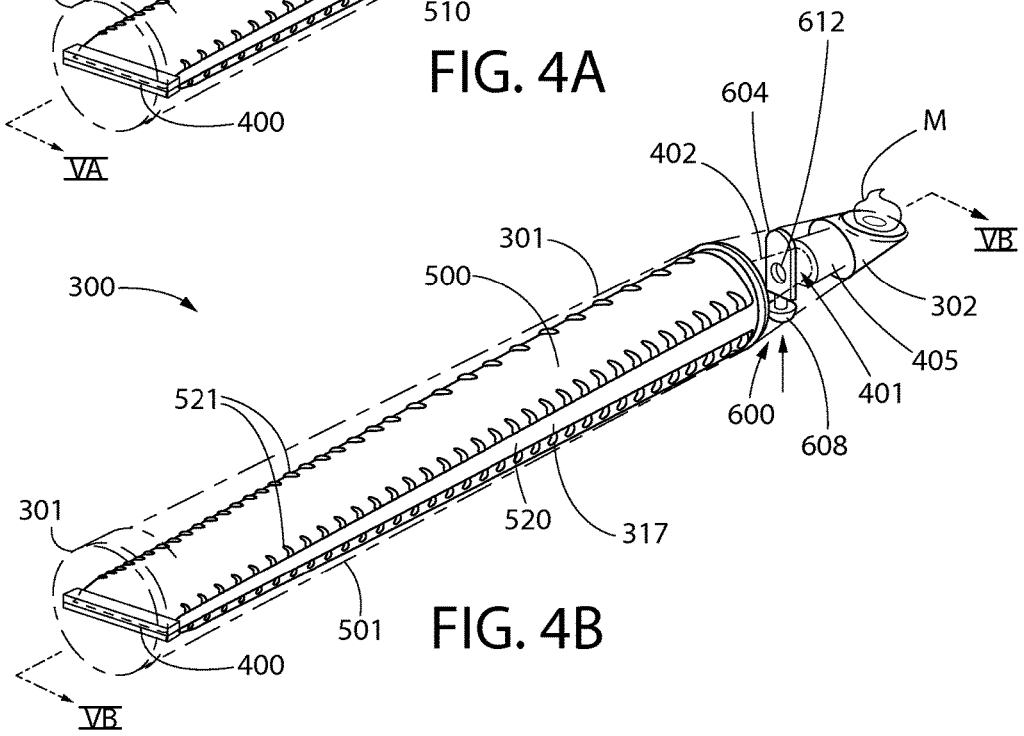

Referring to FIGS. 1-3, an oral care system 100 according to the present invention includes an oral care device such as toothbrush 200 and an oral care material dispenser 300. In one embodiment, the dispenser 300 may be detachably stored in the toothbrush 200 as further described herein. Because the dispenser 300 is stored within the toothbrush 100, the oral care system 100 is highly portable for travel, easy to use, and reduces the amount of required luggage space. Furthermore, by housing the toothbrush 200 and dispenser 300 together, the user is less likely to misplace the dispenser 300 and more inclined to maintain the oral treatment routine with the dispenser since brushing will remind the user to simply detach and apply the contents of the dispenser 300 to complete the oral care treatment regimen.

In exemplary embodiments, the oral care material M may include without limitation the following types of flowable compositions in fluid form: tooth whitening, antibacterial, enamel protection, anti-sensitivity, anti-inflammatory, anti-attachment, fluoride, tartar control/protection, flavorant, sensate, colorant and others. However, other embodiments may be used to store and dispense any suitable type of flowable oral care material M. Accordingly, the invention is expressly not limited to any particular type of oral care material M.

With continuing reference to FIGS. 1-3, the toothbrush 200 has an elongated body and generally includes a handle 210, a neck 220 and a head 230. The handle 210 is configured for gripping by a user to manipulate the toothbrush 200 during brushing. In one embodiment, the handle 210 is configured to detachable store the dispenser 300 therein, as further described herein. Handle 210 may be formed of many different shapes, sizes, and materials formed by a variety of manufacturing methods that are well-known to those skilled in the art. If desired, the handle 210 may include a suitable textured grip made of soft elastomeric material. The handle 210 can be a single or multi-part construction. The handle 210 extends axially from a proximal end 212 to a distal end 213 along a longitudinal axis A-A of the toothbrush 200.

In one embodiment with continuing reference to FIGS. 1-3, handle 210 is an elongated and at least partially hollow structure defining an internal cavity 280 cooperatively configured with dispenser 300 to allow the dispenser to be detachably housed within the cavity until removed and deployed. An opening 215 is provided at proximal end 212 of the handle 210 that provides a passageway into the cavity through which the dispenser 300 can be inserted and retracted. While the opening 215 is located at the proximal end 212 of the handle 210 in the exemplified embodiment, the opening 215 may be located at other positions on the handle 210 in other embodiments of the invention. For example, the opening 215 may be located on a longitudinal surface of the handle 210 (e.g., the front surface, the rear surface and/or either of the opposing side surfaces) in which case the opening 215 is axially elongated to provide sufficient access to the cavity 280 for inserting the dispenser 300.

The handle 210 transitions into the neck 220 at the distal end 213. While the neck 220 generally may have a smaller transverse cross-sectional area than the handle 220, the invention is not so limited. Broadly speaking, the neck 220 is merely the transition region between the handle 210 and the head 230 and can conceptually be considered as a portion of the handle 210 or a portion of the head 230. The head 230 and/or neck 220 may therefore be considered as connected to the distal end 213 of the handle 210.

The head 230 and handle 210 of toothbrush 200 may be formed as a single unitary structure using a molding, milling, machining or other suitable process known in the art. However, in other embodiments, handle 210 and head 230 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 230 and handle 210 are of a unitary or multi-piece construction (including connection techniques) is not limiting of the present invention, unless specifically claimed. In some embodiments of the invention, a replaceable type head 230 may be provided which is detachably mounted to the handle 210 (along with a portion of neck 220) using techniques known in the art, such as disclosed in PCT International Patent Application No. PCT/US2012/042973 filed Jun. 18, 2012, which is incorporated herein by reference in its entirety.

Head 230 generally includes a front surface 231, a rear surface 232 and a peripheral side surface 233 that extends between the front and rear surfaces 231, 232. The front surface 231 of the head 230 includes a plurality of oral cleaning elements such as tooth engaging elements 235 extending therefrom for cleaning and/or polishing contact with an oral surface and/or interdental spaces. While the tooth engaging elements 235 are suited for brushing teeth, the tooth engaging elements 235 can also be used to polish teeth instead of or in addition to cleaning teeth. As used herein, the term "tooth engaging elements" is used in a broad generic sense to refer to any structure that can be used to clean, polish or wipe the teeth and/or soft oral tissue (e.g. tongue, cheek, gums, etc.) through relative surface contact. Common examples of "tooth engaging elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Tooth engaging elements 235 of the present invention can be connected to the head 230 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

Toothbrush 200 and the dispenser 300 are non-unitary separate structures that are specially designed and configured to be detachably coupled together when in an assembled state (referred to herein as a "storage state") and completely isolated and separated from one another when in a disassembled state (referred to herein as an "application state"). The toothbrush 200 and the dispenser 300 are illustrated in the storage state in FIG. 1 and in the application state in FIG. 2. The dispenser 300 can be slidably manipulated and altered between the storage state (FIG. 1) in which the dispenser 300 is located (or docked) in the toothbrush handle 210 and the application state (FIG. 2) in which the dispenser 300 is removed from the handle 210 by the user as desired.

FIGS. 4A-B and 5A-B illustrate one non-limiting embodiment of a dispenser 300 accordingly to the present invention. Dispenser 300 may be an elongated tubular pen-like structure that extends along a longitudinal axis B-B. The dispenser 300 comprises an elongated housing 301, an applicator 302 located in and closing an open distal end 303 of the housing 301, and a proximal end 305 of the housing 301. Distal end 303 may be considered to define a forward end or location and proximal end 305 may be considered to define a rear end or location of dispenser 300. The distal end 303 portion of dispenser 300 may be frusto-conical shaped in some embodiments.

Housing 301 may be a generally circular transverse cross-sectional profile in one embodiment. Of course, in other embodiments, the transverse cross-sectional profile of the housing 301 can take on various non-circular shapes. The housing 301 is constructed of a material and with a wall thickness that is sufficiently rigid to provide the necessary structural integrity and stiffness for handling and dispensing of an oral care material M from the dispenser 300 without substantial deformation. For example, the housing 301 can be formed of a moldable hard plastic. Suitable hard plastics include polymers and copolymers of ethylene, propylene, butadiene, vinyl compounds and polyesters such as polyethylene terephthalate. Others may be used and the invention is not limited to any particular material of construction.

While the housing 301 is exemplified as a single layer construction, in certain embodiments, the housing 301 may be a multilayer construction. In certain multi-layer embodiments, an inner layer can be formed from the hard plastic materials described immediately above while an outer layer can be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness. While an over-molding construction is one suitable method of forming the outer layer, a suitable deformable thermoplastic material, such as TPE, may be formed in a thin layer and attached to inner layer with an appropriate adhesive, sonic welding, or by other means.

Housing 301 of dispenser 300 is an elongated hollow tubular structure extending along the longitudinal axis B-B from the proximal end 305 to the distal end 303. The housing 301 comprises an outer surface 314 and an inner surface 315 that forms an elongated internal chamber 316 for housing a pressurized product tube 317 containing an oral care material M. In one embodiment, proximal end 305 may be open before closure by end cap 306 attached thereto, thereby providing access to chamber 316 for insertion of the collapsible and squeezable product tube 317 with oral care material M. Proximal end 305 may further be closed by an end wall 406.

With continuing reference to FIGS. 4A-B and 5A-B, product tube 317 is axially elongated extending from proximal end 305 to the distal end 303 of dispenser housing 301. A first proximal end 400 of the tube may be sealed by a suitable means such as without limitation heat sealing, crimping, ultrasonic welding, adhesives, or other. An opposing second distal end 401 of the product tube may be terminated with a nozzle 402. The nozzle 402 may include a base 321 connected and sealed to the main body of the tube at distal end 401. Nozzle 402 includes an internal flow conduit 620 and terminal opening 319 forming a flow path for dispensing the oral care material M from the product tube 317. The product tube 317 includes flexible deformable sidewalls 403 extending circumferentially around the tube which are structured to be compressed and collapsed by a compression device 503 for dispensing oral care material M, as further described herein. Sidewalls 403 are constructed to hold the contents of the product tube 317 under a positive pressure.

The sidewalls 403 define an internal reservoir 320 holding a volumetric amount of the oral care material M. In an undeformed state filled with oral care material M, sidewalls 403 of product tube 317 may be approximately circular in transverse cross-sectional shape at least in the middle and nozzled distal end 401 sections of the tube. The product tube 317 may assume a more flattened somewhat rectangular shape near the closed proximal end 400 (see, e.g. FIGS. 5A-B). Other cross-sectional collapsible tube shapes, however, may be provided which are useable with embodiments of the present invention.

Product tube 317 may be made of any suitable flexible material useable for forming squeeze tubes, such as without limitation extruded plastic squeeze tubes formed of HDPE (high density polyethylene) or LDPE (low density polyethylene). Other resilient polymers may be used.

Product tube 317 is filled with a desired flowable oral care material M, which can contain any active oral care agent and/or inactive ingredients. The oral care agent and/or its carrier may be in any form of a fluidic or flowable material including without limitation viscous pastes/gels or less viscous liquid compositions. Any suitable oral care material M can be stored in product tube 317 and used in the present invention. For example, the oral care material M may include any oral care agents such as without limitation oxidative or whitening agents with peroxide-containing chemical compositions which are well known in the art. Other contemplated fluidic oral care materials useable with the present invention include, without limitation: antibacterial agents; enamel strengthening or repair agents; tooth erosion preventing agents; anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents; anti-inflammatory agents; dry mouth relief ingredients; catalysts to enhance the activity of any of these agents; colorants or aesthetic ingredients; dentifrice or toothpaste; and combinations thereof. In some embodiments, the oral care material M does not contain dentifrice or toothpaste and is instead contains active agents or ingredients that provide supplemental oral care benefits in addition to merely brushing one's teeth. Other suitable fluids could include lip balm or other similar materials that are typically available in a highly viscous semi-solid yet flowable state that may be extruded from collapsible bladder 317, as further described herein.

With continuing reference to FIGS. 4A-B and 5A-B, applicator 302 may include a dispensing passageway 318 through which the oral care material M stored in product tube 317 can be dispensed from the dispenser 300. Passageway 318 and the internal flow conduit 620 of the product tube nozzle 402 collectively define an outlet for dispensing the oral care material M. In one embodiment, dispensing passageway 318 is elongated and extends axially through applicator 302 thereby forming a fluid conduit that is in fluid communication with product tube 317 and nozzle 402 for receiving and discharging the oral care material M to the oral surfaces of the user or toothbrush 200 (e.g. toothpaste). In one embodiment, the dispensing passageway 318 may be located in a transversely angled or slanted exposed forward end wall 404 of applicator 302. End wall 404 defines an exposed surface and is angled forward in relation to the longitudinal axis B-B, which facilitates the application of the oral care material M to the teeth, gums, lips, or other oral surfaces. The rear of applicator 302 includes a rear or proximally projecting tubular socket 405 configured for insertion of nozzle 402 from product tube 317 as shown. Tubular socket 405 fluidly and mechanically couples the product tube to the applicator 302. Socket 405 has a central axial passageway which is in fluid communication with nozzle 402 on collapsible bladder 317 and passageway 318. Other suitable ways of coupling nozzle 402 to applicator 302 are possible.

In certain alternative embodiments using a liquid and low viscosity oral care material M fluid, a porous applicator 302 may be provided which is constructed of a material that supports capillary fluid transport. Various porous polymeric foams or other suitable capillary materials may be used. In such embodiments, dispensing passageway 318 may be omitted as the entire porous applicator will conduct the fluidic oral care material M from the product tube nozzle 402 to the exposed surface on front wall 404 for application to the target oral tissue. Furthermore, in certain other embodiments, the dispensing passageway 318 can be located in other areas of the housing 301, such as on one of the longitudinal side walls of the dispenser 300 and/or applicator 302. In some embodiments, a plurality of dispensing passageways 318 can be provided. For example, the plurality of dispensing passageways 318 can be provided in a generally circular configuration that may be used to facilitate the fluid being dispensed through the applicator 302.

In one embodiment, applicator 302 may be formed of a soft resilient material, such as an elastomeric material. Suitable elastomeric materials include thermoplastic elastomers (TPE) or other similar materials used in oral care products. The elastomeric material of the outer layer may have a hardness durometer measurement ranging between A13 to A50 Shore hardness, although materials outside this range may be used. A suitable range of the hardness durometer rating is between A25 to A40 Shore hardness.

In alternative embodiments, the applicator 302 may be constructed of bristles, a porous or sponge material, or a fibrillated material. Suitable bristles include any common bristle material such as nylon or PBT. The sponge-like materials can be of any common foam material such as urethane foams. The fibrillated surfaces can be comprised of various thermoplastics. The invention, however, is not so limited and the applicator 302 can be any type of surface and/or configuration that can apply a viscous substance onto the hard surface of teeth, including merely an uncovered opening/passageway.

The applicator 302 may have a generally circular transverse cross section fitted at least partially into open distal end 303 of dispenser 300. Applicator 302 may be flushed mounted with the distal end 303 of dispenser 300 in some embodiments as shown in FIGS. 4A-B and 5A-B. In other embodiments, the applicator protrudes beyond the front end surfaces of the dispenser 300. Either arrangement may be used.

Referring to FIGS. 4A-B and 5A-B, proximal end 305 of dispenser housing 301 may have any suitable configuration. In one embodiment, open proximal end 305 may be closed by a rear end wall 406. End wall 406 may be flat in one embodiment, or have another suitable configuration in other embodiments including angled, curved, or other. The end wall 406 may be constructed to be inserted into open end 305 of housing 301 after insertion of the collapsible bladder 317. The end wall 406 may be a separate unitary structure or in other embodiments be an integral unitary part of end cap 306 which is affixed to the proximal end 305 of the dispenser housing 301 (see also FIGS. 1 and 2).

End wall 406 of dispenser housing 301 may optionally be configured to include a clamping member 410 disposed on an interior surface inside internal chamber 316 of the dispenser 300. Clamping member 410 may have a horizontally split structure with upper and lower halves configured to grip opposing sides of the proximal end 400 of product tube 317. This holds the tube in position during dispensing of the oral care material M from the tube via compression device 503. In some embodiments, clamping member 410 may be configured to also engage the proximal ends 509 of upper and lower pressure plates 500, 501 of the compression device 503 with the proximal end 400 of product tube 317 being sandwiched therebetween. In one embodiment, the proximal end 400 of product tube 317 and/or pressure plates 500, 501 may be releasably affixed to end wall 406 of dispenser housing 301. It will be appreciated that in other embodiments, clamping member 410 may be omitted.

The compression device 503 and the oral care material M dispensing mechanism will now be further described with reference to FIGS. 4A-B, 5A-B, and 6.

Compression device 503 provides a compression mechanism configured to engage product tube 317 for automatically dispensing oral care material M from the 317. In one embodiment, compression device 503 includes an open front end 510, closed rear end 511, and an opposing pair of an upper pressure plate 500 and lower pressure plate 501 operably and resiliently coupled together. Each pressure plate 500, 501 is axially elongated and may be arcuately shaped in transverse cross section. In other embodiments, the plates may have straight cross sectional shape. The pressure plates 500, 501 are configured and operable to simultaneously engage opposing sidewalls 403 of product tube 317. This applies an inward directed compressive force Fc which places the contents of the product tube 317 (e.g. oral care material M) under a continuous positive pressure and ready for dispensing.

Each pressure plate 500, 501 includes a distal end 502, proximal end 504, and pair of axially extending longitudinal edges 505 defining an elongated longitudinally extending compartment 506 configured for insertion of product tube 317 between the plates. In one embodiment, the proximal ends 504 of the pressure plates 500, 501 are disposed proximate to each other and may be abutting. The distal ends 502 may be spaced apart to define the open front end 510 of the compression device 503 through which the product tube 317 may be axially inserted. Longitudinal edges 505 may have any suitable shape including straight. In one embodiment, the edges 505 may be ridged or scalloped.

The upper and lower compression pressure plates 500, 501 of compression device 503 may be formed of any suitable rigid material, including moldable hard plastic or metal. Injection molded hard plastics that may be used include polymers and copolymers of ethylene, propylene, butadiene, vinyl compounds and polyesters such as polyethylene terephthalate. Others materials may be used and the invention is not limited to any particular material of construction. Each pressure plate 500, 501 may be one piece having a unitary construction.

In one embodiment, the upper pressure plate 500 and lower pressure plate 501 may be resiliently coupled together by a pair of longitudinally extending elastomeric members 520. Each elastomeric member 520 is configured to engage mating opposing longitudinal edges 505 of upper and lower pressure plates 500, 501 along the lateral sides of the compression device 503. Elastomeric members 520 may each be continuous in structure and extend axially between the distal and proximal ends 502, 504 of the pressure plates 500, 501 without interruption for the entire length or nearly the entire length of the plates (see, e.g. FIGS. 4A-B). In other embodiments, the elastomeric members 520 may be spaced intermittently along the longitudinal edges 505 of the pressure plates 500, 501 forming an interrupted and discontinuous pattern. This latter construction is possible because the oral care material M is disposed inside product tube 317.

The elastomeric members 520 are deformable and stretchable by application of a force. Elastomeric members 520 have an elastic memory which returns the members to a non-deformed condition when the force is removed. Any suitable resilient material having an elastic memory may be used. In one non-limiting embodiment, the elastomeric members 520 may be made of thermoplastic elastomers (TPE). Preferably, the material selected for elastomeric members 520 has a tensile strength and tear properties suitable to allow the material to be stretched through a desired range of deformation in operation without breaking or experiencing excessive compression set (i.e. permanent deformation).

In one embodiment, each elastomeric member 520 may include a plurality of integrally formed elongated resilient anchors 521 permanently attached to the upper and lower pressure plates 500, 501 along opposite lateral sides of the plates. In one arrangement, the anchors 521 are attached along the longitudinal edges 505 of the pressure plates 500, 501. The anchors 521 may have a transversely elongated finger-like construction and configuration; however, other configurations of anchors 521 may be used. An upper and lower opposing row of anchors 521 may be provided for each elastomeric member 520 with the anchors in each row being are oriented transversely to the longitudinal axis B-B and extending in opposing transverse directions. Other suitable arrangements of anchors 521 may be used.

Anchors 521 form anchor points for attaching each elastomeric member 520 to an upper and lower pressure plate 500, 501 to resiliently couple the plates together along their longitudinal edges 505. Because the anchors 521 each have smaller axial width (measured along longitudinal axis B-B) than an entire elastomeric member 520, they are more resilient and stretchable in the transverse direction when the pressure plates 500, 501 are transversely pulled or pushed apart, as further described herein. In one embodiment, the anchors 521 may be spaced at intervals axially along a majority or substantially the entire length of the pressure plates 500, 501 as shown. Any suitable number of anchors 521 may be provided.

While an over-molding construction is one method that may be used for attaching the anchors 521 of the elastomeric members 520 to the upper and lower pressure plates 500, 501, other suitable methods may be used such as an appropriate adhesive, sonic welding, or others. It will also be appreciated that in other possible embodiments, the anchors 521 may be formed separately from the elastomeric members 520 and attached thereto by any suitable means, such as adhesives, sonic welding, or others.

Figure 7A:
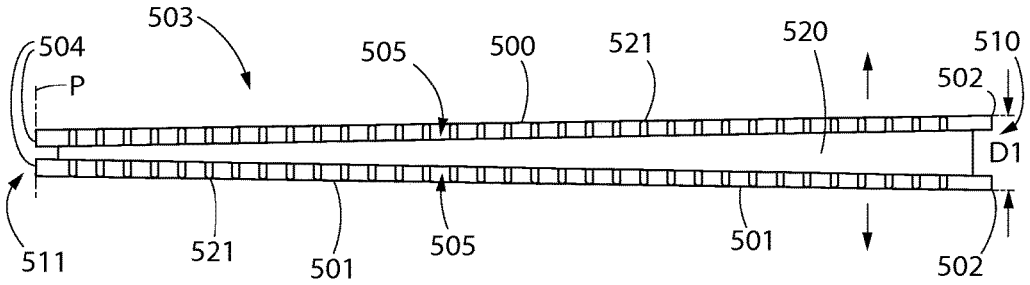
FIG. 7A is a side elevation view of a compression device of the dispenser in a closed position.
Figure 7B:
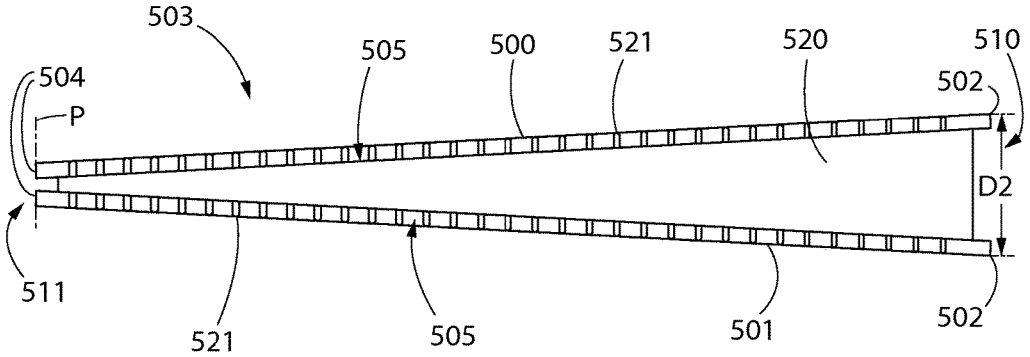
FIG. 7B is a side elevation view of the compression device in an open position.

In operation, the upper and lower pressure plates 500, 501 of compression device 503 are pivotably and resiliently movable apart and together in relation to each other about a pivot point P, as shown in FIGS. 7A and 7B. The pivot point P may be formed at proximal end 400 of the product tube 317 by the proximal ends 504 of the pressure plates 500, 501 which are disposed in close proximity to each other. FIG. 7A shows the compression device 503 and pressure plates 500, 501 in a closed unbiased position. The longitudinal edges 505 of each pressure plates 500, 501 are disposed proximate to each other. This is particularly noticeable at the distal ends 502 and adjoining longitudinal edges 505 of each pressure plate which are in close proximity. In the unbiased position, the distal ends 502 are transversely spaced apart by a distance D1. The elastomeric members 520 along each lateral side of the pressure plates 500, 501 are not stretched or deformed being in an inactive relaxed condition.

When a filled product tube 317 is positioned at least partially between the pressure plates 500, 501 (see, e.g. FIGS. 4A-B), the plates are each transversely displaced and resiliently spread apart in relation to each other. FIG. 7B shows the compression device 503 and pressure plates 500, 501 in this open biased position being spread apart against the biasing force of elastomeric members 520 which acts to pull the plates back together. The longitudinal edges 505 of each pressure plates 500, 501 are now disposed more distally to each other than in the closed position (compare to FIG. 7A). The distal ends 502 of the pressure plates 500, 501 are transversely spaced apart by a second distance D2 which is larger than first distance D1. The diameter of open front end 510 of compression device 503 has also changed from a first diameter associated with the closed position to a larger second diameter associated with the open position. Notably, the elastomeric members 520 along each lateral side of the pressure plates 500, 501 have deformed and are transversely stretched in an active stretched condition. The elastic memory of the elastomeric members 520 biases the pressure plates 500, 501 back towards the closed position, thereby exerting an inward compressive force Fc against opposing sidewalls 403 of the product tube 317. This operates to automatically extrude and dispense oral care material from the product tube 317.

To control and regulate dispensing of oral care material M from product tube 317, an actuator mechanism 600 is provided. In one embodiment shown in FIGS. 4A-B and 5A-B, the actuator mechanism 600 may include a valve 602 comprising a plug 604, a stem 606 operably coupled to the plug, and an operating button 608 with biasing spring 610 operably coupled to the stem on one end and configured to be depressed by a user for dispensing oral care material M. In the exemplified embodiment, the operating button 608 extends from a side of the dispenser housing 301 that is opposite the facing direction of the end wall 404 of the applicator 302. This can be beneficial so that the user's hands and fingers are kept out of the way when the operating button 608 is being depressed and the applicator is positioned in or near a user's mouth for direct application of the oral care material M to the user's teeth or other oral surfaces. Of course, the invention is not to be so limited in all embodiments and the operating button 608 can be positioned at other locations on the dispenser housing 301 as desired.

The plug 604 includes a portion movably and slideably disposed in nozzle 402 to intercept the flow path of oral care material M between the distal end 401 of product tube 317 and terminal opening 319. In one non-limiting embodiment, the valve 602 may be a gate valve and plug 604 may be configured as a generally flat plate as shown. Other suitable types and configurations of valves and plugs may be provided. The plug 604 is slideably inserted through a pair of diametrically opposed transverse slots 614 formed through the top and bottom of the nozzle 402. The plug 604 may be configured to slide through both the top and bottom slots 614 such that the upper end of the plug may protrude upwards through the top slot and nozzle 402 (see, e.g. FIGS. 5A and 5B). A relatively snug fit and/or seals may be provided between the plug 604 and nozzle slots 614 to prevent oral care material M from leaking into the interior of dispenser housing 301 from the nozzle 402.

Figure 5A:
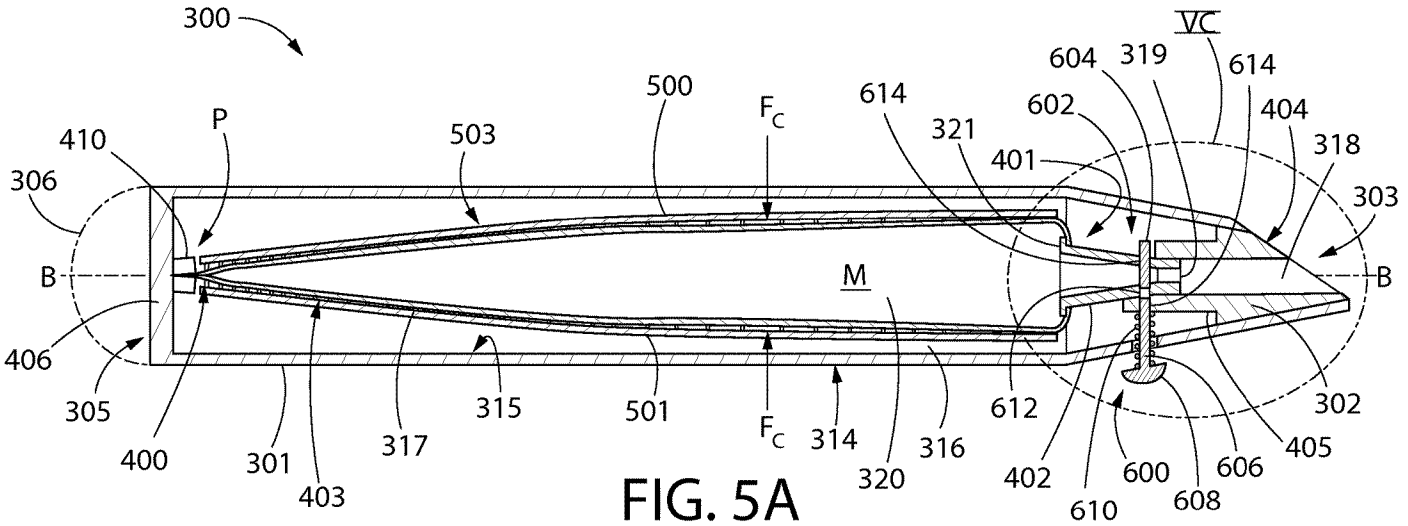
FIGS. 5A and 5B are side cross-sectional views of the dispenser with FIG. 5B showing an oral care material being dispensed.
Figure 5B:
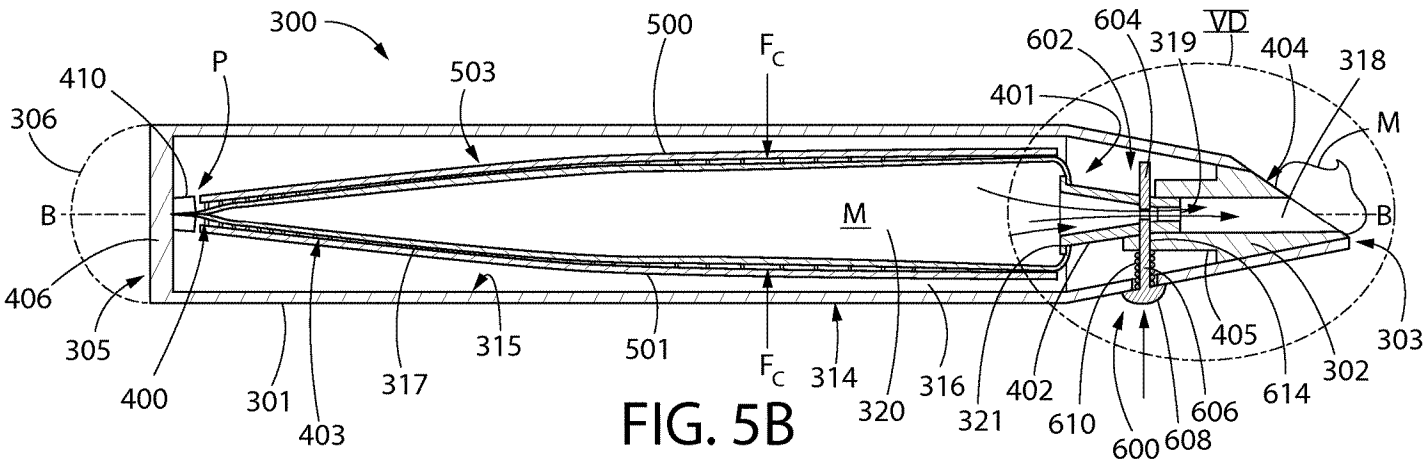
Figure 5C:
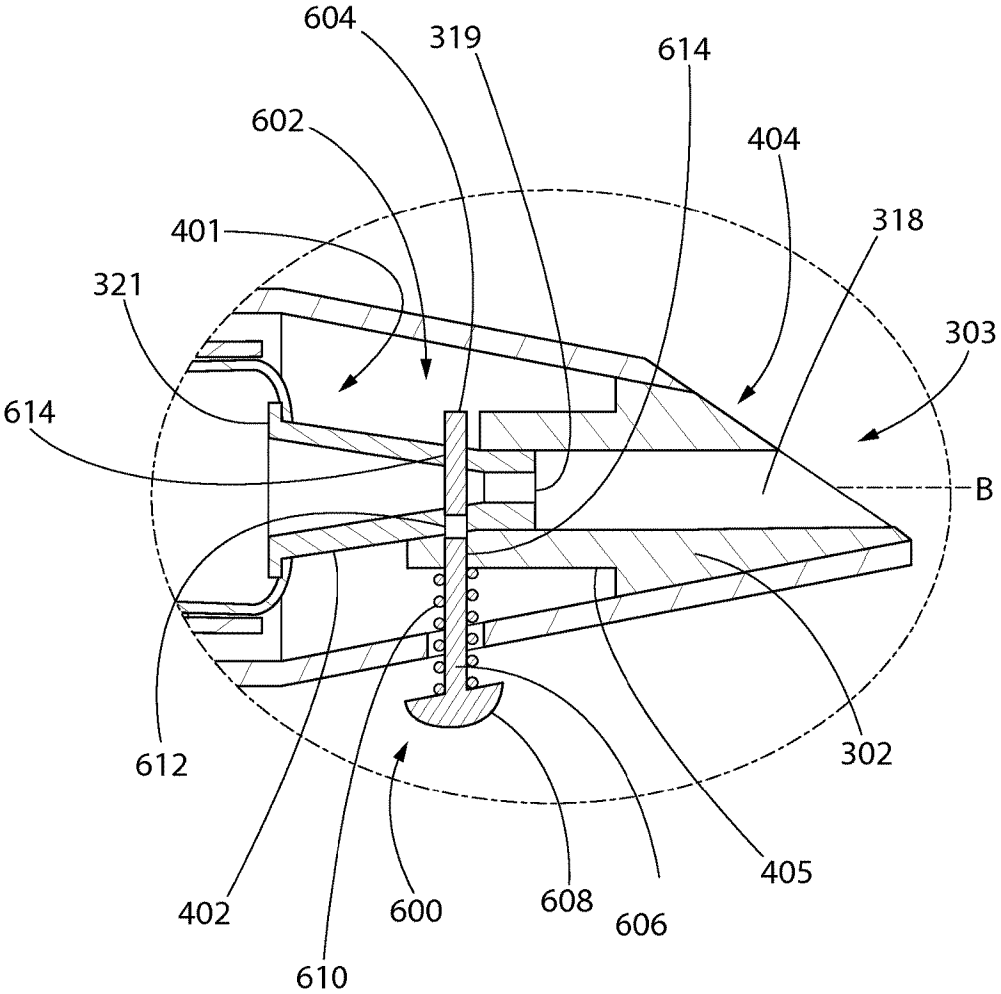
FIGS. 5C and 5D are enlarged views taken from FIGS. 5A and 5B, respectively.
Figure 5D:
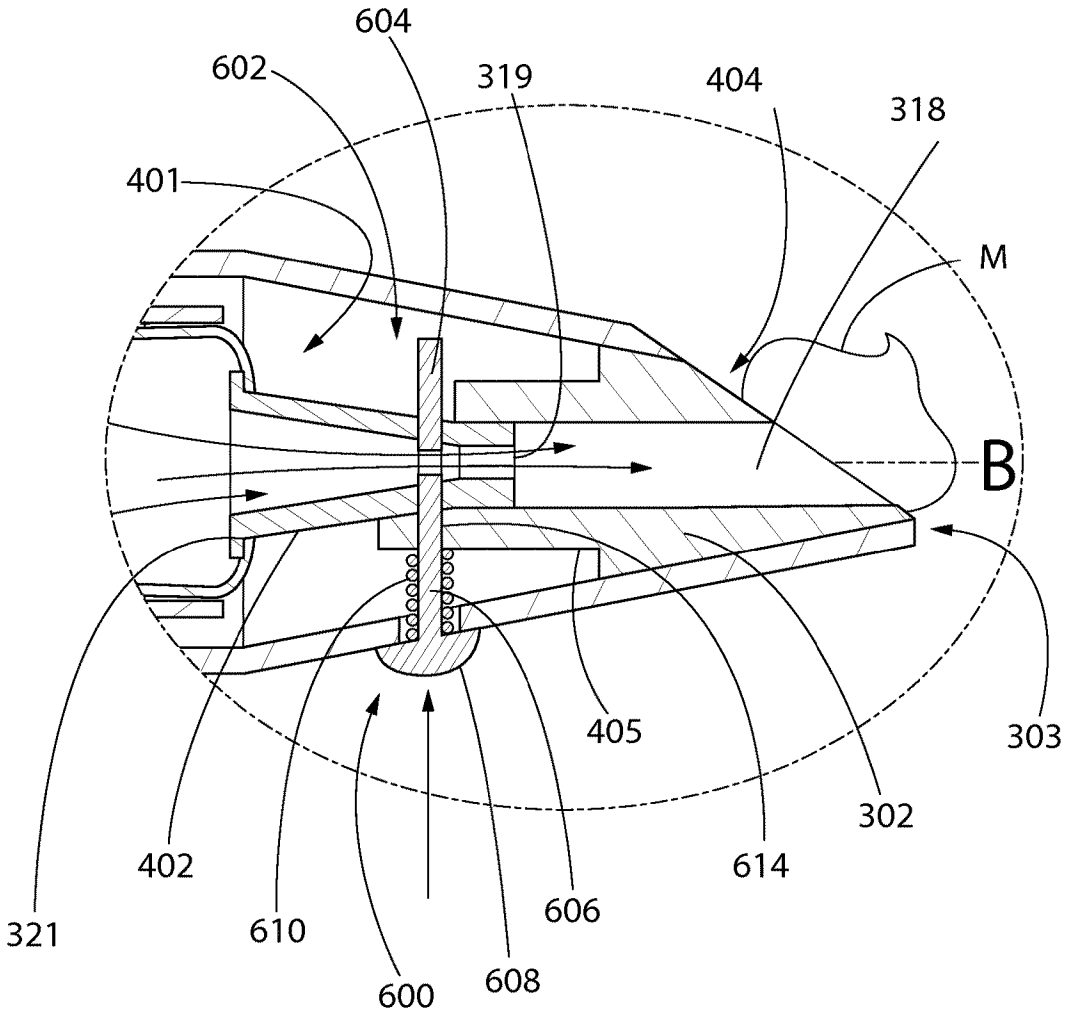
Figure 6:
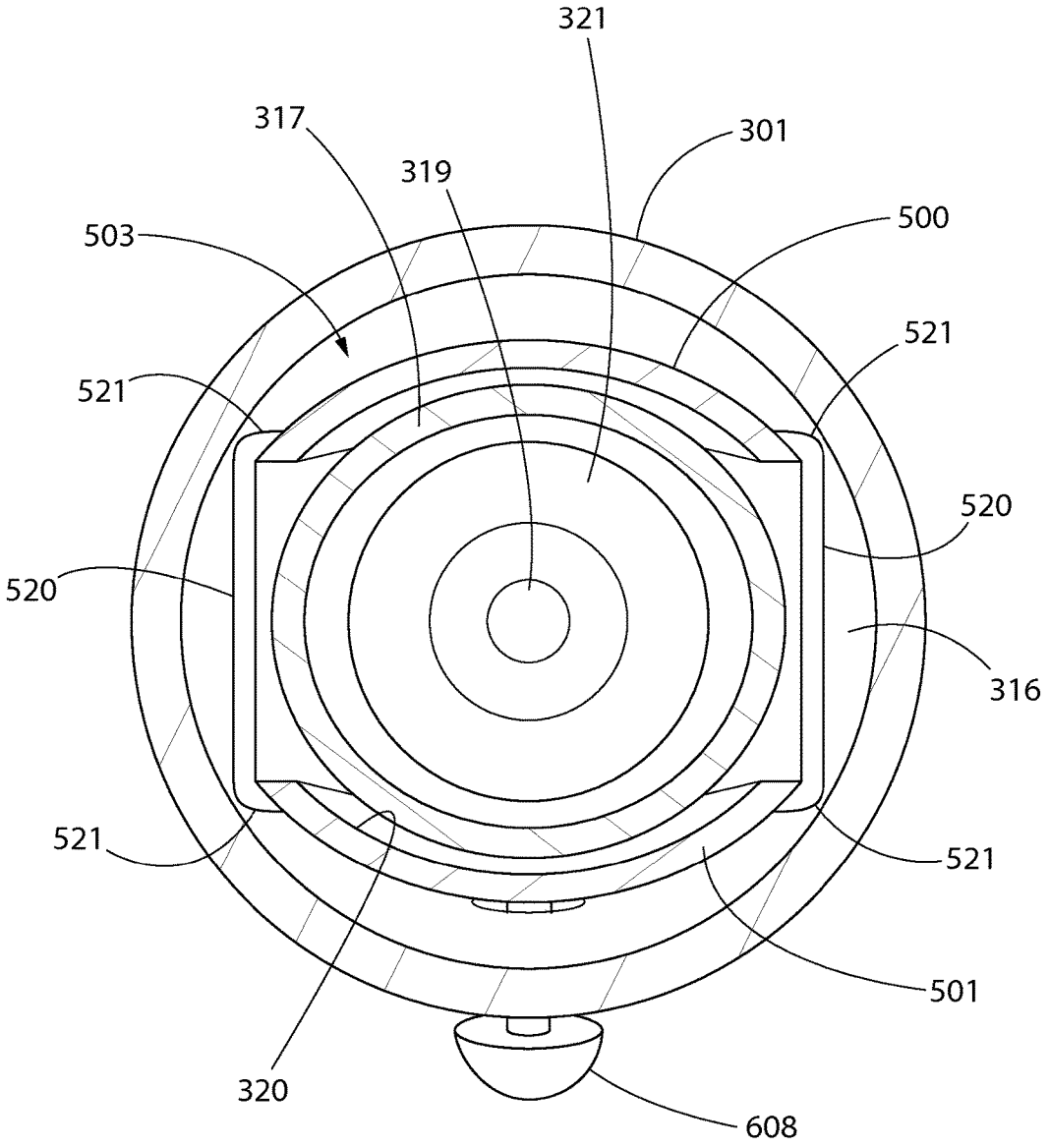
FIG. 6 is a transverse cross-sectional view of the dispenser taken along line VI-VI in FIG. 4A.

Plug 604 further includes a flow orifice 612 which is transversely movable into and out of the nozzle 402 and its interior flow path for the oral care material M which is axially oriented along longitudinal axis B-B. In one embodiment, the orifice 612 may be disposed between the upper and lower ends of the plug 604 The actuator 600/valve 602 is movable between an open dispensing position wherein oral care material M is dispensed from product tube 317 when the orifice 612 is positioned inside the nozzle 402, and a closed non-dispensing position wherein oral care material M is blocked from being dispensed when the orifice is positioned outside at least the interior flow path through the nozzle. Because the contents of the product tube 317 are under pressure created by compression device 503 as described herein, oral care material M will be automatically dispensed when a user depresses operating button 608 (inwards against the force of spring 610 which is compressed) to activate the actuator 600. This moves the orifice 612 into concentric alignment with the nozzle 403 corresponding to the open dispensing position of actuator 600/valve 602, as shown in FIG. 5B. The spring 610 normally biases the operating button 608 into a projected outward position corresponding to the closed non-dispensing position of actuator 600/valve 602, as shown in FIG. 5A.

In one embodiment, the components of valve 602 may be disposed inside distal end 303 of the dispenser housing 301 except for operating button 610 and adjoining portion of stem 606 which extends through the housing. The valve components may be made of any suitable materials, such as plastic (with possible exception of spring 610 which may be formed of spring steel). In one embodiment, the plug 604 and stem 606 may be of integral unitary construction.

In alternative or additional embodiments, the valve 602 may be located in dispenser 300 such that the plug 304 with flow orifice 614 is slideably insertable through the fluid passageway 318 in applicator 302 instead of the internal flow conduit 620 inside the product tube nozzle 402. In either construction, the plug 604 is operable to intercept and interrupt the flow of oral care product M from the tube 317 and dispenser 300 to prevent unintentional dispensing.

A method for dispensing oral care material M from dispenser 300 will now be summarized from the foregoing description. A dispenser 300 is first provided which is filled with oral care material M. The compression device 503 and pressure plates 500, 501 are in the open position shown in FIG. 7B. In this position, the pressure plates 500, 501 actively apply an inward directed compressive force Fc against the product tube 317 (i.e. sidewalls 403) and place its contents under pressure. The actuator 600/valve 602 is in the closed non-dispensing position shown in FIG. 5A wherein oral care material M is blocked from being dispensed by plug 604 of the valve 602. Operating button 608 is not depressed and actuated. The valve flow orifice 612 is not fully inserted into product tube nozzle 402 such that the flow path of oral care material M through the nozzle is blocked by a solid portion of valve plug 604 to prevent dispensing the material. Accordingly, the flow orifice 612 is not axially aligned with the flow path of oral care material M through the nozzle 402 and passageway 318.

To dispense oral care material M, a user depresses operating button 608 to active the actuator (see directional arrow). This in turn linearly translates the plug 604 of valve 602 in a first transverse direction, thereby further slideably inserting the plug through nozzle 402 to position and axially align flow orifice 612 inside the nozzle in the flow path of oral care material M, as shown in FIG. 5B. The actuator 600/valve 602 is now in the open dispensing position allowing oral care material M under pressure in product tube 317 to be dispensed by the valve 602. In certain embodiments, the pressure is a constant pressure regardless or irrespective of the amount of oral care material M within the product tube 317 so that a predetermined amount of the oral care material M is dispensed per unit time regardless of the amount of oral care material M remaining. Of course, the invention is not to be so limited in all embodiments and in certain other embodiments the pressure can be variable based upon the amount of oral care material M within the product tube 317.

When the actuator 600/valve 602 is in the open dispensing position, the compression device 503 squeezes and pushes the oral care material M inside product tube 317 forward and distally towards nozzle 402. The oral care material M now freely flows through valve flow orifice 612 and nozzle 402 into dispensing passageway 318, and then outwards from the applicator 302 for delivery to the target oral surfaces or an oral care implement such as toothbrush 100. With each dispensing action, the pressure plates 500, 501 move farther and farther towards the closed position shown in FIG. 7A under the biasing effect of elastomeric members 520 which pull the plates back together.

During the foregoing dispensing action, it should be noted that the user may hold the operating button 608 inwards to continue to dispense a desired quantity of oral care material M. Releasing the operating button causes the valve 602 to automatically close under the biasing action of spring 610 and stop dispensing oral care material. This linearly translates the plug 604 of valve 602 in a second opposite transverse direction, thereby slideably removing the flow orifice 612 from inside the nozzle 402 and the flow path of oral care material M, as shown in FIG. 5A. In certain embodiments, the spring 610-stem 606 assembly may be lubricated with a low viscosity lubricant for slow return of the valve 602 to the closed non-dispensing position. Advantageously, this allows a user to quickly depress and release the operating button 608, thereby dispensing a predetermined dosage of oral care material M while the flow orifice 612 remains positioned inside the product tube nozzle 402. Any mode of operation is acceptable depending on the quantity of oral care material M that the used desires to dispense.

It will be appreciated that other forms of compression devices 503 beside the non-limiting exemplary embodiment disclosed herein may be used to pressurize the contents of product tube 317. For example, the internal chamber 316 of dispenser housing 301 may be hermetically sealed and pressurized with an inert gas at a suitable positive pressure to exert the inward compressive force Fc on the product tube 317. Other forms of elastomeric members 520 may be used or alternatively variously configured mechanical spring elements may be provided that are configured and arranged to maintain the product tube contents in a relatively continuous pressurized state. Accordingly, the compression device is not limited by the form or configuration of the device disclosed herein. The term "continuous" as used herein with respect to the pressure maintained in the product tube is intended to connote the tube contents are maintained under pressure, recognizing that the pressure may gradually decrease as the oral care material is dispensed over time.

The process of detaching and reattaching the dispenser from the toothbrush 200 will now be described. Referring initially to FIG. 1, the dispenser 300 is illustrated in the storage state. When in the storage state, the dispenser 300 is docked within the cavity 280 of the handle 210 of the toothbrush 200. An interference fit between the outer surface 314 of the dispenser 300 and an inner surface 240 of the toothbrush 200 that forms the cavity 280 detachably couples and retains the dispenser 300 to the toothbrush 200. When the dispenser 300 is in the storage state, at least a portion, and preferably a majority, of the dispenser 300 is located within the internal cavity 280 of the toothbrush 200. The end cap 306 preferably exposed and outside of internal cavity 280 to be grasped by a user for axially withdrawing the dispenser 300 from the cavity.

In certain embodiments, the handle 210 of the toothbrush 200 will have a feature that enables the operating button 608 to fit within the cavity 280. Specifically, the inner surface 240 of the toothbrush 200 may include a slot or channel that receives the operating button 608 when the dispenser 300 is slidably inserted into the cavity 280 so that the operating button 608 is not depressed when the dispenser 300 is in the storage state. Such a slot or channel may extend from the proximal end 212 of the handle 200 a distance into the cavity 280 sufficient to enable the operating button 608 to slide within the slot or channel through the entire distance that the operating button 608 extends into the cavity 280.

In the exemplified embodiment, the entirety of the housing 301 of the dispenser 300, including the applicator 302, are located within the cavity 280 of the toothbrush 200 when the dispenser 300 is in the storage state. The end cap 306 of the dispenser 300, however, protrudes axially from the proximal end 212 of the handle 210 of the toothbrush 200. This allows a user to readily grasp, axially withdraw, and deploy the dispenser. In one embodiment, the end cap 306 may be dome shaped continues the natural curved contour of the handle 210. This conceals the dispenser 300 and provides a rounded proximal end to the oral care system 100, thereby providing a look that aesthetically resembles a traditional manual toothbrush. It will be appreciated that other suitable end cap 306 shapes may be provided.

To remove the dispenser 300 in the application state shown in FIG. 2, the user merely grasps end cap 306 and axially withdraws the dispenser from internal cavity 280 of toothbrush 200. With the dispenser 300 now undocked from toothbrush handle 210, the user may dispense the oral care material M in the manner described above by axially advancing the compression device assembly 500 towards the distal end 303 of the dispenser 300. When finished, the user may then axially reinsert the dispenser 300 into internal cavity 280 of toothbrush 200. In one embodiment, an axially elongated sealing plug 530 may be disposed near the distal end of toothbrush internal cavity 280 to help seal the dispensing passageway 318 in applicator 302 when the dispenser 300 is docked in the toothbrush handle 210. The sealing plug 530 is concentrically aligned with dispensing passageway 318 when dispenser 300 is positioned inside internal cavity 280 of toothbrush handle 210. This helps prevent inadvertent dispensing or leakage of oral care material M from dispenser 300 when docked.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A dispenser comprising:

a housing defining a longitudinal axis;

a pressurized product tube disposed in the housing and including a reservoir containing a material;

an outlet in fluid communication with the reservoir;

a valve fluidly coupled to the outlet, the valve being movable between an open dispensing position and a closed non-dispensing position; and a compression device disposed inside the housing of the dispenser, the compression device configured to apply pressure to the product tube for dispensing the material, wherein the compression device includes a pair of opposing pressure plates resiliently biased into engagement with opposing sides of the product tube, the plates operable to squeeze the material from the reservoir when the valve is in the open dispensing position;

wherein the valve is configured to dispense the material from the reservoir under pressure when in the dispensing position;

wherein the valve includes an orifice movable into and out of a flow path defined through the outlet; and wherein the pressure plates are resiliently coupled together by a pair of elastomeric members each anchored to mating opposing longitudinal edges of the pressure plates along opposing lateral sides of the compression device.

2. The dispenser according to claim 1, wherein the valve is biased towards the closed position.

3. The dispenser according to claim 1, wherein:

when the valve is in the open dispensing position, the orifice is positioned in the flow path; and when the valve is in the closed non-dispensing position, the orifice is positioned outside the flow path.

4. The dispenser according to claim 1, further comprising an applicator mounted on a distal end of the dispenser in fluid communication with the reservoir.

5. The dispenser according to claim 4, wherein the product tube includes a nozzle fluidly coupled to the applicator, the nozzle being inserted in a rearwardly open socket formed in the applicator.

6. The dispenser according to claim 1, wherein each pressure plate is axially elongated and encloses a majority of a length of the product tube.

7. The dispenser according to claim 1, wherein the pressure plates are transversely movable together and apart in relation to each other from a closed position to an open position, the pressure plates being biased towards the closed position by the elastomeric members.

8. The dispenser according to claim 1, wherein the elastomeric members are formed of thermoplastic elastomers.

9. The dispenser according to claim 1, wherein the housing is configured for insertion into a handle of a toothbrush.

10. The dispenser according to claim 1 wherein the valve is configured to dispense the material from the reservoir under constant pressure when in the dispensing position irrespective of an amount of the material contained in the reservoir.

11. An oral care system comprising:

a toothbrush including a head, and a handle coupled to the head and having an internal cavity;

a dispenser detachably mounted in the internal cavity of the handle;

the dispenser including:

a housing defining a longitudinal axis;

a pressurized tube disposed in the housing and including a reservoir containing an oral care material;

an outlet in fluid communication with the reservoir;

a valve fluidly coupled to the outlet, the valve being movable between an open dispensing position and a closed non-dispensing position; and a compression device disposed inside the housing of the dispenser, the compression device configured to apply pressure to the product tube for dispensing the material, wherein the compression device includes a pair of opposing pressure plates resiliently biased into engagement with opposing sides of the product tube, the plates operable to squeeze the material from the reservoir when the valve is in the open dispensing position;

wherein the valve is configured to dispense oral care material from the reservoir under pressure when in the dispensing position;

wherein the valve includes an orifice movable into and out of a flow path defined through the outlet; and wherein the pressure plates are resiliently coupled together by a pair of elastomeric members each anchored to mating opposing longitudinal edges of the pressure plates along opposing lateral sides of the compression device.

12. The oral care system according to claim 11, wherein:

when the valve is in the open dispensing position, the orifice is positioned in the flow path; and when the valve is in the closed non-dispensing position, the orifice is positioned outside the flow path.

13. A method for dispensing a material, the method comprising:

providing a dispenser including a housing defining a longitudinal axis, a pressurized product tube disposed in the housing and including a reservoir containing a material, and an outlet in fluid communication with the reservoir and defining a flow path for dispensing the material;

engaging opposite sides of the product tube with a compression device operably exerting an inward directed force on the reservoir;

actuating a valve fluidly coupled to the outlet of the dispenser and including a flow orifice, the orifice movable into and out of the flow path;

positioning the orifice into the flow path; and dispensing the material from the dispenser.

* * * * *